US005329728A

United States Patent [19]

Ray

[11] Patent Number: 5,329,728

[45] Date of Patent: Jul. 19, 1994

[54] PLANT POT HANGER

[75] Inventor: Glenn A. Ray, Santa Clara, Calif.

[73] Assignee: Garco Enterprises, Santa Clara, Calif.

[21] Appl. No.: 917,553

[22] Filed: Jul. 21, 1992

[51] Int. Cl.[5] ..... A01G 9/02; A47G 7/02

[52] U.S. Cl. ..... 47/67; 248/318; 24/555

[58] Field of Search ..... 47/67; 248/318; 24/555, 24/563

[56] References Cited

U.S. PATENT DOCUMENTS

| | | | |
|---|---|---|---|
| 778,786 | 12/1904 | Kramer | 248/318 |
| 941,448 | 11/1909 | Haglund . | |
| 1,095,504 | 5/1914 | Jannoch . | |
| 1,265,139 | 5/1918 | Tittle, Jr. | 24/555 |
| 1,331,569 | 2/1920 | Knapp | 248/318 |
| 1,334,199 | 3/1920 | Weiseman | 47/67 |
| 1,369,965 | 3/1921 | Cornstock | 47/67 |
| 2,266,294 | 12/1941 | Allderdice | 47/67 |
| 2,316,263 | 4/1943 | Little | 47/67 |
| 2,530,456 | 11/1950 | Fracchia | 248/318 |
| 2,967,691 | 1/1961 | Lehnbeuter et al. . | |
| 3,120,044 | 2/1964 | DiPiano | 24/555 |
| 3,184,203 | 5/1965 | Steen . | |
| 4,014,506 | 3/1977 | Hanson | 47/67 |
| 4,235,407 | 11/1980 | Haas | 47/67 |
| 4,440,371 | 4/1984 | Wijsman . | |
| 4,603,507 | 8/1986 | Nelson | 248/318 |
| 4,630,795 | 12/1986 | Kagan . | |
| 5,074,504 | 12/1991 | Minnick | 47/67 |

FOREIGN PATENT DOCUMENTS

| | | | |
|---|---|---|---|
| 9576 | 4/1904 | United Kingdom | 47/67 |

*Primary Examiner*—Truy M. Bui
*Assistant Examiner*—Joanne C. Downs
*Attorney, Agent, or Firm*—Skjerven, Morrill, MacPherson, Franklin & Friel

[57] ABSTRACT

A pot hanger for a vertically hanging pot with or without a drain saucer includes a series of flat sheet, generally inverted U-shaped spaced clips. A lower distal end of the clips seats on a downwardly-facing surface of the plant container or the saucer while an upper distal end seats against an inner surface of a pot container or saucer peripheral circular ridge. One or a pair of apertures are formed in a bight portion of each clip with a bottom chain link of a corresponding series of chains affixed therein. The tops of all of the chains are fixed into a common swivel, snap or S-type hook and the hook mounted on a provided support nail or screw hook. A tab is provided on each of the clips to facilitate removal of a clip from a pot container or saucer.

9 Claims, 3 Drawing Sheets

PLANT POT HANGER

FIELD OF THE INVENTION

This invention relates to plant pot hangers. More particularly, the invention is directed to a suspension-type vertical hanger for a clay or plastic type pot, with or without a drain saucer thereunder.

BACKGROUND OF THE INVENTION

Heretofore various sized clay, ceramic, or plastic pots, such as plant pots and containers, have been hung from a nail, hook, horizontal beam or other support by two or three spaced wires with hooks extending through a pot aperture or by wires twisted therein, with an upper hook or twisted wire connection which can be dangled from the support. Various macrame hangers of various fibers have been utilized which form an open basket-like bottom into which a pot is placed with fiber strands angularly extending therefrom to an upper knot which can be fixed into a hook or nail forming the support. Welded iron rings and an iron bottom or wire clips have been employed for supporting pots with rod elements extending uniformly to a loop which hangs on a supporting hook nail or the like. Welded steel wires or chains extending from a bottom disc have also been employed. U.S. Pat. Nos. 941,448; 1,095,504; 1,334,199; 2,530,456; 2,967,691; 3,184,283; 4,235,407; 4,440,371; and 4,630,795 are representative of prior patented hangers. The above described and shown hangers generally and variably are relatively unattractive, can easily be bent out of shape, can be broken, are not durable, are limited to only one pot size, are limited in hanger diameter or must be hung at a fixed vertical height.

SUMMARY OF THE INVENTION

The pot hanger of this invention utilizes an angularly spaced series of flat, resilient clips of integral one-piece construction with one distal end which clips onto and seats on a generally downward facing horizontal portion of a pot exterior surface, a second distal end which terminates against an inner surface of a pot portion peripheral circular ridge, and apertures in an upper bight portion of the clip between the distal ends, into which apertures are fixed the bottom ends of a series of hanging elements such as elongated chains. A swivel, S-type or other hook connects the opposite ends of the chains and the remainder of the hook is inserted over a nail, screw hook or otherwise suspended from a suitable support above the then suspended pot. The pot may be hung with or without a drain saucer of various types. A moderate spring holding restraint is provided when the clips are affixed to a plant container or drain saucer. The clips, chains and the swivel, snap or S-type connector provide a hanger which can accommodate a wide range of pot sizes, allows positioning the pot over a wide range of vertical heights, stably holds the plant despite movement from wind action or during plant watering sequences, allows for rotation of the pot to facilitate spraying of water or fertilizer or for removal of dead growth, and can be easily and quickly be disassembled for use with another pot of equal or different size. Preferably the clips are made from aluminum, stainless steel, brass or plastic, so as to be rust resistant. Similarly, the chains are preferably plated steel, stainless steel or brass for strength and rust resistance.

DETAILED DESCRIPTION

Figure 1:
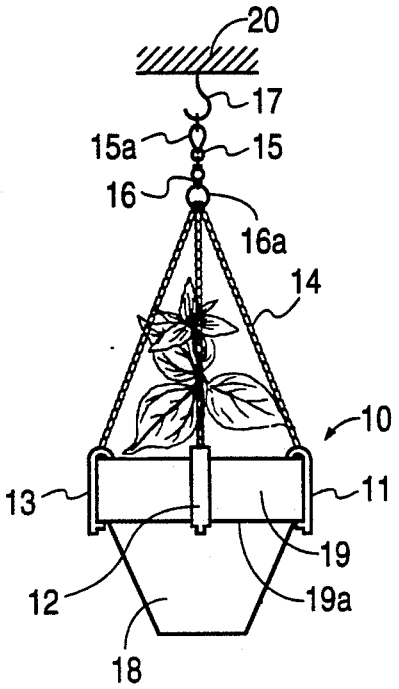
FIG. 1 shows a side view of an assemblage of clip hangers supporting a plant container.
Figure 2:
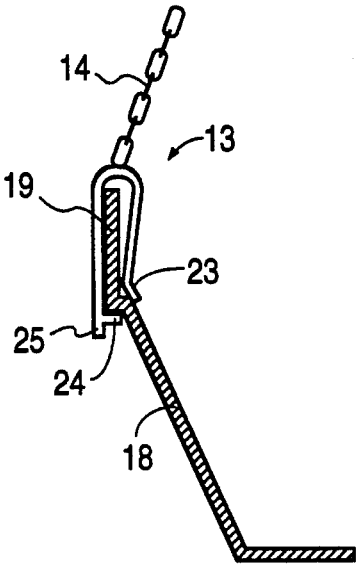
FIG. 2 is an end view of a clip per se showing its affixation to a cross-sectioned pot upper edge.

One embodiment of the pot hanger 10 of the invention is seen in FIGS. 1–4 in which a series of flat sheet, generally inverted U-shaped clips 11, 12 and 13 support a pot container 18 for plants or the like. The clips are attachable to a pot peripheral circular ridge 19. Each clip includes two elongated legs 21 and 22, the former having a distal end 24 which, in assembly on pot 18, is essentially horizontal and seats on a generally downward-facing horizontal surface 19*a* of the ridge 19. The other distal end 23 terminates against an inner surface of ridge 19 as seen in FIG. 2. Depending from between the horizontal distal ends or tabs 24 is a vertical tang or pull tab 25 for easily releasing tabs 24 from ridge 19 by manual movement.

Figure 3:
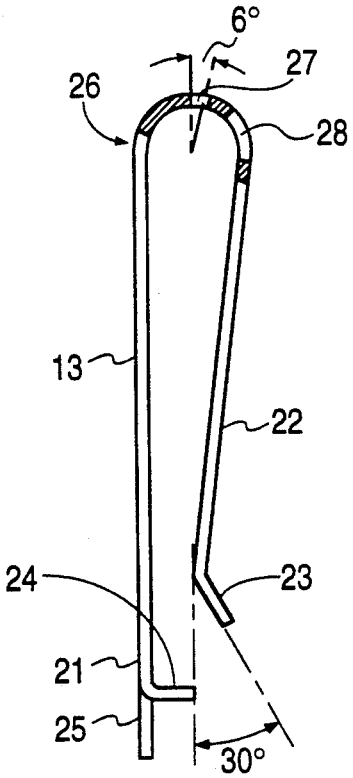
FIG. 3 is a detailed end view partially in cross-section of a clip per se.
Figure 4:
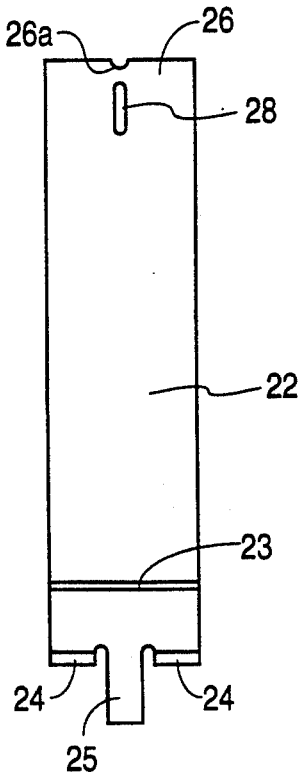
FIG. 4 is a side view thereof.
Figure 5:
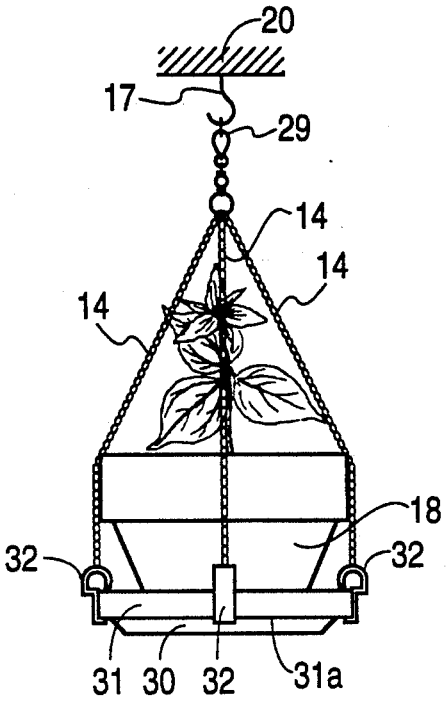
FIG. 5 is a side view of an assemblage of a second embodiment of clip hangers for holding a pot-supporting drain saucer.
Figure 9:
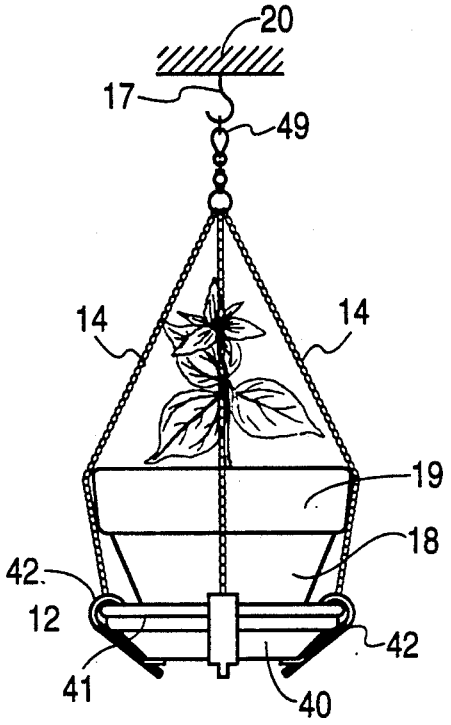
FIG. 9 is a side view of an assemblage of a third embodiment of clip hangers for supporting an "Italian Style" drain saucer and pot.

A curved upper bight portion 26 integrally connects legs 21 and 22 and includes a pair of upwardly-facing apertures 27 and 28 aligned and spaced from each other. A loop of a chain or an interconnecting loop is passed through the apertures so that the bridge 26*a* in bight portion 26 supports a chain link or connecting loop extending through both apertures. The oval-shaped aperture 28 permits a wide range of the degree of angularity of chains 14 with respect to the pot as dictated by the hanging length of the chains. Each chain 14 has an upper end loop which is inverted in a lower portion 16 (FIG. 1) of a swivel, snap or S-type support clip 15 which has an upper portion 15*a* which is slipped over a screw hook 17 or other support member affixed to a fixed wood beam or like surface 20. A connecting loop 16*a* may be employed to connect the chains to the support clip 16. The support clip may be an S-type hook clip 29 as seen in FIG. 5 or a swivel clip 49 as seen in FIG. 9. The aperture 27 is preferably displaced about 6° from the vertical toward oval aperture 28 to insure free-hanging of the pot container. Distal end 23 is preferably bent about 30° as also shown in FIG. 3 so that the pot interior is not chipped or scarred by the insertion and removal of resilient clip 13 along the interior of ridge 19.

Figure 6:
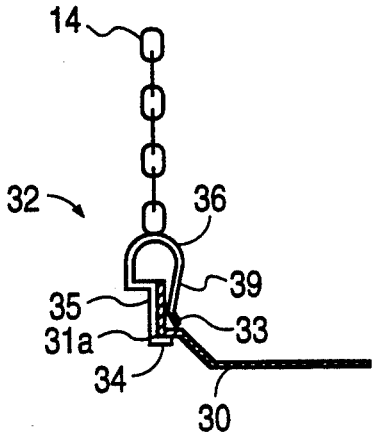
FIG. 6 is an end view of the clip of the second embodiment showing its affixation to a cross-sectioned saucer edge.
Figure 7:
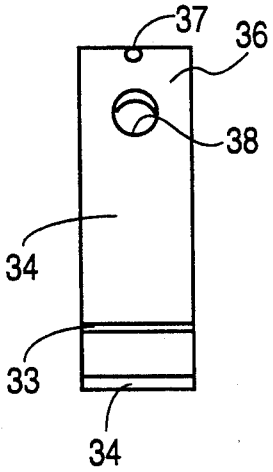
FIG. 7 is a detailed end view of the second embodiment of the clip.
Figure 8:
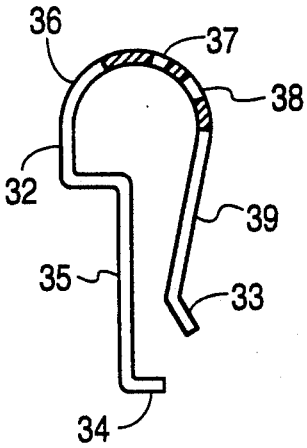
FIG. 8 is a side view thereof in partial cross-section.

In the FIG. 5 embodiment, the pot container 18 is supported by a pot portion in the form of a drain saucer 30 having a peripheral circular ridge 31. A series of clips 32, which preferably are three in number angularly spaced 120° or four clips angularly spaced 90° from each other, hang from chains 14 and have horizontal distal ends 34 (FIG. 6) which seat on a generally downwardly-facing horizontal pot saucer circular surface 31*a*. As in the FIG. 1 embodiment, the inner leg 39 of clip 32 includes a curved distal end 33 while the outer leg 35 includes distal end 34. The bight portion 36 includes a small circular aperture 37 and a larger circular or oval shaped aperture 38 each being angularly offset from the vertical longitudinal axis of the elongated clip 32. The bight portion has an expanded head shaped resultant from being bent at a greater bend radius. In the FIG. 1 embodiment, a bend radius of 0.31 R (inches) is employed while in the FIG. 5 embodiment, the bend radius is 0.41 R (inches). The bent tip 33 further facilitates easy removal of the clips 32 from saucer 30 by manually prying the clip from the saucer.

Figure 10:
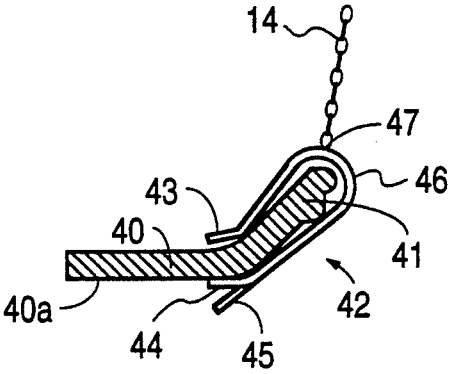
FIG. 10 is an end view of the third embodiment of the clip showing its affixation to a cross-sectioned saucer edge.

FIGS. 9 and 10 illustrate a third embodiment which employs a hanging clip 42 which supports a so-called "Italian-Style" saucer 40 having a peripheral circular ridge 41. Ridge 41 extends flatter (about at a 45° angle) than the vertical ridge 31 shown in FIG. 5. Clips 42 are mounted at an angle corresponding to the angle of the ridge 41 with curved distal end 43 seating on the ridge interior and distal end 44 terminating horizontally and supporting the horizontal bottom 40*a* of saucer 40. A suitable aperture(s) 47 is provided in bight portion 46 into which a loop of chain 14 is affixed. Tab 45, as tab 25 in FIGS. 1–4, extending at an angle from end 44 facilitates removal of the clip from saucer 40.

The clips of the invention are preferably made of 0.062 inch thick 6061-T6 aluminum sheet and have in the FIG. 1 embodiment a length of 2.39 inches and width of 0.75 inches. FIGS. 3, 4, 7 and 8 are actual 1:1 scale. The clips of the invention may hang standard pots or saucers made of clay, ceramic, wood, or other materials.

The above description of embodiments of this invention is intended to be illustrative and not limiting. Other embodiments of this invention will be obvious to those skilled in the art in view of the above disclosure.

I claim:

1. A pot hanger for a vertically hanging port having one pot portion including a top peripheral circular ridge, said hanger comprising:

a series of clips consisting essentially of angularly spaced, flat sheet, generally inverted U-shaped resilient spring clips of integral one-piece construction, each of said clips having a first distal essentially horizontal inwardly-facing tab adapted for seating under a downwardly facing pot exterior surface, a second distal bent end adapted for terminating against an inner surface of the pot peripheral circular ridge such that said clips are adapted to be springedly secured to the pot portion to fully support a weight of the pot portion, an upper bight portion adapted for bridging across the top of said peripheral circular ridge, and at least one aperture in said upper bight portion of each of said clips between said distal ends and extending along a medial longitudinal axis of each clip;

a series of angularly spaced discrete hanging elements separate from said clips, each hanging element having a first end entering a respective one of said at least one aperture of said clips and connecting the hanging element to the clip; and means for connecting the opposite ends of said hanging elements to a support such that the weight of the pot portion is stably supported by said clips and said hanging elements.

2. The pot hanger of claim 1 in which said one pot portion is a plant-holding container.

3. The pot hanger of claim 1 in which said one pot portion is a drain saucer for a plant-holding container.

4. The pot hanger of claim 1 wherein said first distal tab includes a depending integral pull tang adapted for releasing said inwardly-facing tab from the pot peripheral circular ridge.

5. The pot hanger of claim 1 wherein said hanging elements are a series of spaced chains and wherein said at least one aperture in each clip is a pair of spaced apertures including a first circular aperture and an oval aperture each allowing for reception of a lower end of a chain at various angular orientations of said series of chains.

6. The hanger of claim 5 in which said means for connecting comprises a one-piece swivel clip having a lower bight portion for confining an upper end of each of said hanging element chains and a pivotable upper spring portion for attachment to a support.

7. The pot hanger of claim 1 in which said series of hanging element are three chains spacedly extending to 120° spacings from a 120° spaced three of said clips to said means for connecting.

8. A pot hanger for a vertically hanging pot, said hanger comprising:

a plurality of angularly spaced, flat sheet, generally inverted U-shaped resilient spring clips of one-piece integral construction, each of said clips having a first leg and a second leg resiliently connected together at a proximal end, said first leg terminating at a distal end with a first essentially horizontal angled portion which is adapted to seat on a downwardly facing, substantially horizontal surface of a pot portion, said second leg having a bent end adapted to seat on an interior wall surface of a wall of the pot;

said second leg being shorter than said first leg, said second leg and said first leg adapted to provide opposing resilient forces to the wall of the pot such that the weight of the hanging pot may be fully supported by said first angled portion on each of said clips; and means for connecting said clips to a support.

9. The pot hanger of claim 8 wherein said distal end of said first leg has a release tang extending from adjacent a root of said first angled portion for releasing said clips from the pot portion.

* * * * *